US010165813B2

(12) United States Patent
Martin

(10) Patent No.: US 10,165,813 B2
(45) Date of Patent: Jan. 1, 2019

(54) SLEEVE GUSSET FOR AN APPAREL ITEM

(71) Applicant: NIKE, Inc., Beaverton, OR (US)

(72) Inventor: Lindsey V. J. Martin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/974,280

(22) Filed: Dec. 18, 2015

(65) Prior Publication Data

US 2017/0172237 A1 Jun. 22, 2017

(51) Int. Cl.

| | |
|---|---|
| ***A41D 13/00*** | (2006.01) |
| ***A41D 15/00*** | (2006.01) |
| ***A41D 27/10*** | (2006.01) |
| ***A41D 3/00*** | (2006.01) |
| ***A41D 27/02*** | (2006.01) |
| ***A41D 27/20*** | (2006.01) |

(52) U.S. Cl.

CPC ..... *A41D 27/10* (2013.01); *A41D 3/00* (2013.01); *A41D 27/02* (2013.01); *A41D 27/201* (2013.01); *A41D 2200/20* (2013.01)

(58) Field of Classification Search

CPC ..... A41D 27/10; A41D 27/02; A41D 3/00; A41D 15/00; A41D 15/005

USPC ..... 2/70, 69

See application file for complete search history.

(56) References Cited

U.S. PATENT DOCUMENTS

| | | | | |
|---|---|---|---|---|
| 2,159,408 A | | 5/1939 | Siegel | |
| 2,291,025 A | | 7/1942 | Casella | |
| 2,305,406 A | | 12/1942 | Clyne et al. | |
| 2,407,383 A | | 9/1946 | Previdi | |
| 2,447,989 A | | 8/1948 | Previdi | |
| 2,474,400 A | * | 6/1949 | Morris | A41D 1/02 2/93 |
| 2,500,084 A | | 3/1950 | Metzger | |
| 2,514,276 A | | 7/1950 | Berman | |
| 2,522,356 A | | 9/1950 | Firestone | |
| 2,694,202 A | * | 11/1954 | Macrides | A41D 27/10 2/108 |

(Continued)

FOREIGN PATENT DOCUMENTS

| | | |
|---|---|---|
| CN | 2805411 Y | 8/2006 |
| GB | 190516194 A | 7/1906 |

(Continued)

OTHER PUBLICATIONS

International Search Report and Written Opinion dated Mar. 14, 2017 for International Patent Application No. PCT/US2016/067212, 14 pages.

*Primary Examiner* — Timothy K Trieu

(74) *Attorney, Agent, or Firm* — Shook, Hardy and Bacon LLP

(57) ABSTRACT

A sleeve gusset for securing an exterior shell layer of an apparel item and an inner liner layer of an apparel item to a sleeve of an apparel item and a method of manufacturing a sleeve gusset is provided. The sleeve gusset comprises an interior facing with a sleeve edge and a body edge and an exterior facing with a sleeve edge and a body edge. The sleeve edge of the exterior facing is coupled to the exterior shell layer of the apparel item while the sleeve edge of the interior facing is coupled to the sleeve. The body edge of the exterior facing is coupled to the body edge of the interior facing. The body edge of the interior facing is further coupled to the inner liner layer.

20 Claims, 6 Drawing Sheets

(56) References Cited

U.S. PATENT DOCUMENTS

| | | | | | |
|---|---|---|---|---|---|
| 2,716,240 | A | | 8/1955 | Trageser | |
| 2,831,195 | A | | 4/1958 | Dolin | |
| 2,839,756 | A | | 6/1958 | Geiss | |
| 2,967,305 | A | * | 1/1961 | Scott | A62B 17/00 2/2.13 |
| 3,049,719 | A | * | 8/1962 | Carman | A41D 27/10 2/108 |
| 3,137,860 | A | * | 6/1964 | Bindler | A41D 27/10 2/115 |
| 3,574,236 | A | * | 4/1971 | Getchell | B64G 6/00 2/2.13 |
| 4,408,356 | A | * | 10/1983 | Abrams | A41D 27/28 2/87 |
| 4,630,320 | A | | 12/1986 | Van Gompel | |
| 4,999,850 | A | * | 3/1991 | Grilliot | A41D 13/00 2/126 |
| 5,163,183 | A | * | 11/1992 | Smith | A41D 13/02 2/458 |
| 6,895,597 | B1 | | 5/2005 | Rakic | |
| 2014/0090146 | A1 | * | 4/2014 | Yeomans | A41D 1/002 2/69 |
| 2016/0198778 | A1 | * | 7/2016 | Hines | C08K 3/0033 2/269 |

FOREIGN PATENT DOCUMENTS

| | | | |
|---|---|---|---|
| GB | 510122 | A | 7/1939 |
| JP | 3145113 | U | 9/2008 |
| WO | 2015034722 | A1 | 3/2015 |

* cited by examiner

SLEEVE GUSSET FOR AN APPAREL ITEM

FIELD

This technology relates to a sleeve gusset for securing an exterior layer of an apparel item, an inner liner layer of the apparel item, and a sleeve at a sleeve region of the apparel item. Additional aspects comprise an enhanced mobility garment using the sleeve gusset and a method of manufacturing a gusseted garment using a sleeve gusset to secure a body portion, a lining portion, and a garment sleeve.

SUMMARY

Aspects of the sleeve gusset are defined by the claims below, not this Summary. The following high-level overview of various aspects provides an overview of the disclosure and introduces a selection of concepts that are further described in the Detailed Description. This Summary is not intended to identify key features or essential features of the claimed subject matter, nor is it intended to be used as an aid in isolation to determine the scope of the claimed subject matter.

In brief and at high level, this disclosure describes, among other things, a sleeve gusset used to secure an exterior shell layer of an apparel item, an inner liner layer of an apparel item, and a sleeve at a sleeve region of the apparel item. In one aspect, the sleeve gusset comprises an interior facing with a body edge and a sleeve edge and an exterior facing with a body edge and a sleeve edge. The sleeve edge of the exterior facing is coupled to an exterior shell layer of an apparel item while the sleeve edge of the interior facing is coupled a sleeve of an apparel item. The exterior facing and interior facing are coupled together along the body edges of the exterior facing and the interior facing. The interior facing is also coupled at its body edge to the inner liner layer of an apparel item. The coupling of the sleeve gusset to the exterior shell layer, the inner liner layer, and the sleeve enables the gusset to move between a retracted position and an extended position, thereby giving greater mobility and an increased range of motion to a wearer of an apparel item with the sleeve gusset.

In further aspects, an enhanced mobility garment is comprised of an exterior shell layer, an inner liner layer, a sleeve, and a gusset with an interior facing and an exterior facing. A sleeve edge of the exterior facing is coupled to the exterior shell layer while a sleeve edge of the interior facing is coupled the sleeve. The exterior facing and interior facing are coupled together along a body edge of the exterior facing and a body edge of the interior facing. The interior facing is also coupled at its body edge to the inner liner layer.

In another aspect, a garment with a gusset is manufactured by a method comprising of providing a sleeve portion of a material; providing a body portion of a material; providing a lining portion of a material, wherein the lining portion is coupled to the body; and fixing the garment sleeve to the rest of the garment via a gusset. To fix the sleeve to the garment via a gusset, one edge of a first layer of the gusset is attached to the sleeve portion, and a second edge on a second layer of the gusset is attached to the body portion. A bi-fold pleat between the first layer and the second layer of the gusset is attached to the lining portion.

DESCRIPTION OF THE DRAWINGS

Illustrative aspects are described in detail below with reference to the attached drawing figures, and wherein.

DETAILED DESCRIPTION

Figure 1:
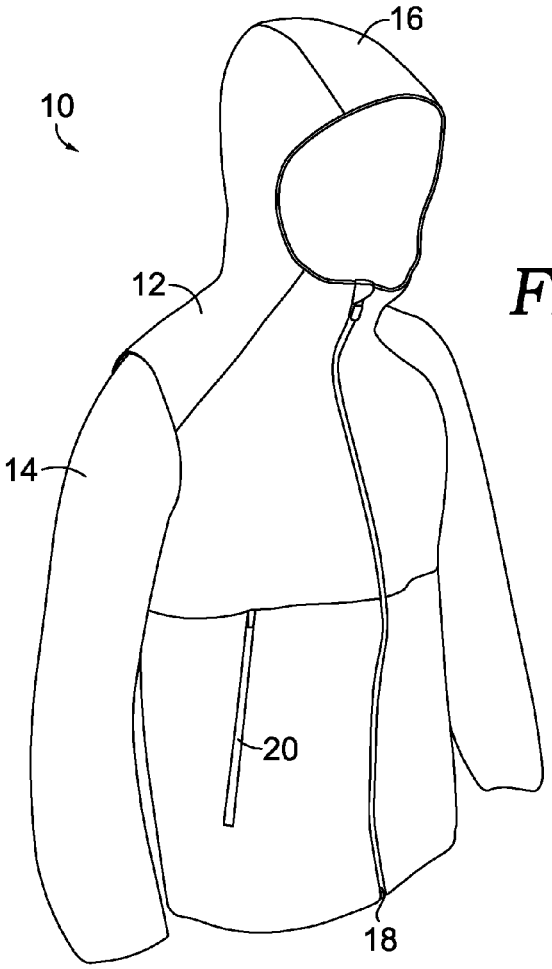
FIG. 1 is a perspective view of the exterior of an exemplary outerwear apparel with a sleeve gusset in which the sleeve gusset is in a retracted position in accordance with an aspect herein.

The subject matter is described with specificity herein to meet statutory requirements, but the description itself is not intended to necessarily limit the scope of the claims. Rather, the claimed subject matter might be embodied in other ways to include different components, steps, or combinations thereof similar to the ones described in this document, in conjunction with other present or future technologies. Terms should not be interpreted as implying any particular order among or between various steps disclosed unless and except when the order of individual steps is explicitly described.

Aspects of the technology are directed to a sleeve gusset used to secure an exterior shell layer of an apparel item, an inner liner layer of an apparel item, and a sleeve at a sleeve region of the apparel item. In one aspect, the sleeve gusset comprises an interior facing with a body edge and a sleeve edge and an exterior facing with a body edge and a sleeve edge. The sleeve edge of the exterior facing is coupled to the exterior shell layer of an apparel item while the sleeve edge of the interior facing is coupled the sleeve of an apparel item. The exterior facing and interior facing are coupled together along the body edges of the exterior facing and the interior facing. The interior facing is also coupled at its body edge to the inner liner layer of an apparel item. The coupling of the sleeve gusset to the exterior shell layer, the inner liner layer, and the sleeve enables the gusset to move between a retracted position and an extended position, thereby giving greater mobility to a wearer of an apparel item with the sleeve gusset.

In further aspects, an enhanced mobility garment is comprised of an exterior shell layer, an inner liner layer, a sleeve, and a gusset with an interior facing and an exterior facing. A sleeve edge of the exterior facing is coupled to the exterior shell layer while a sleeve edge of the interior facing is coupled the sleeve. The exterior facing and interior facing are coupled together along a body edge of the exterior facing and a body edge of the interior facing. The interior facing is also coupled at its body edge to the inner liner layer.

In another aspect, a garment with a gusset is manufactured by a method comprising of providing a sleeve portion of a material; providing a body portion of a material; providing a lining portion of a material, wherein the lining portion is coupled to the body; and fixing the sleeve portion to the rest of the garment via a gusset. To fix the sleeve to the garment via a gusset, one edge of a first layer of the gusset is attached to the sleeve portion, and a second edge on a second layer of the gusset is attached to the body portion. A bi-fold pleat between the first layer and the second layer of the gusset is attached to the lining portion.

In some aspects, the width of the inner liner layer is smaller than the width of the exterior shell layer. The difference in width between the inner liner layer and the exterior shell layer may allow the gusset to retract to its normal position when the apparel item is not being worn in a way that requires greater mobility.

With reference now to the figures, devices and methods for creating a sleeve gusset are provided. Configurations depicted comprise an outerwear jacket with an a sleeve gusset attaching an arm sleeve to an exterior shell layer and inner liner layer. However, it is contemplated that a sleeve gusset may be used on other apparel items and to connect other types of sleeves, such as a pant sleeve, to at least two fabric layers of the apparel item. Therefore, while this discussion provides for a sleeve gusset for use with an arm sleeve, it is understood that gussets with other types of sleeves are contemplated. Additionally, various aspects are described with respect to the figures in which like elements are depicted with like reference numerals.

Turning first to FIG. 1, a perspective view of the exterior of an exemplary apparel item 10 with a sleeve gusset in a retracted position is provided. As visible from the an exterior view, the apparel item 10 may comprise an exterior shell layer 12, which covers at least a portion of a wearer's torso when in an as-worn configuration, and an arm sleeve 14, a tubular piece of material configured to cover at least at least a portion of a wearer's arm when in an as-worn configuration. This apparel item 10 may also comprise additional features such as a hood 16, at least one front pocket 20, and a front closure mechanism 18 to releasably secure front panels of the apparel item 10. The front closure mechanism 18 may comprise a zipper-type mechanism, as is shown in FIG. 1, or another coupling mechanism such as buttons, snap fasteners, and the like.

Figure 2:
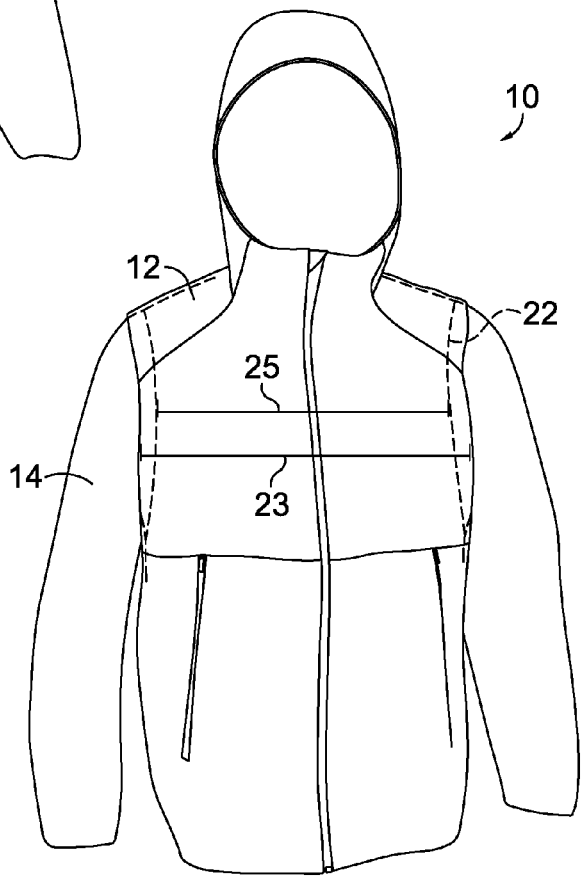
FIG. 2 is a front view of the outerwear apparel with the sleeve gusset of FIG. 1 in accordance with an aspect herein.

FIG. 2 provides a front view of the exemplary apparel item in FIG. 1. In FIG. 2, an inner liner layer 22 is outlined with dashed lines. In exemplary aspects, the inner liner layer 22 lays underneath the exterior shell layer 12 and, therefore, is not otherwise visible when viewing the exterior of the apparel item 10 as in FIG. 1. Like the exterior shell layer 12, the inner liner layer may be configured to cover at least a portion of a wearer's torso when in an as-worn configuration.

The exterior shell layer 12 may have a first width 23 between an edge comprising a right armhole and an edge comprising a left armhole of the exterior shell layer 12, and the inner liner layer 22 may have a second width 25 between an edge comprising a right armhole and an edge comprising a left armhole of the inner liner layer 22. In some aspects and as shown in FIG. 2, the second width 25, i.e., the width of the inner liner layer 22, is smaller than the first width 23, i.e., the width of the exterior shell layer 12. The difference in widths between the inner liner layer 22 and the exterior shell layer 12 may allow the gusset, which is attached to the exterior shell layer 12, the inner liner layer 22, and the arm sleeve 14 as described below, to retract to its normal position when the apparel item 10 is being worn in a way that does not require greater mobility, such as when a wearer's arms are by the wearer's sides. The normal, retracted position of the gusset is illustrated in FIGS. 1-2. The differences in the widths 23 and 25 between the inner liner layer 22 and the exterior shell layer 12 may also help to conceal the gusset by extending the exterior shell layer 12 beyond the point where the gusset attaches to the arm sleeve 14. Accordingly, when retracted, the gusset is not visible from the exterior of the apparel item 10, according to one aspect.

Figure 3:
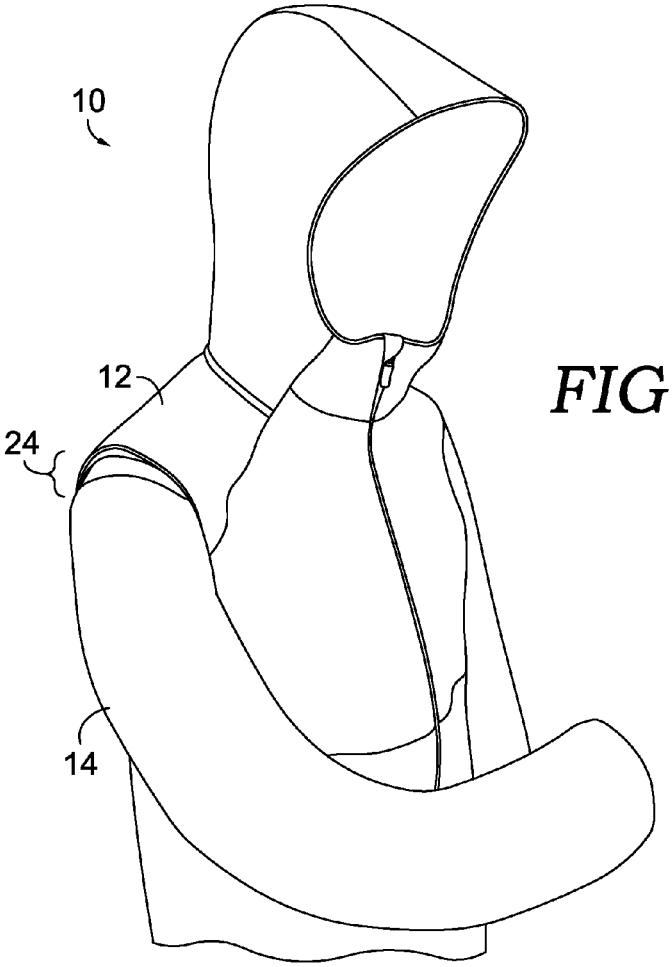
FIG. 3 is a perspective view of the outerwear apparel with the sleeve gusset of FIG. 1 in which the sleeve gusset is in an extended position in accordance with an aspect herein.

The gusset may be visible, however, when in an extended form, as shown in FIG. 3. In FIG. 3, a gusset 24 is visible from the exterior of the apparel item 10 as the gusset 24 extends beyond the exterior shell layer 12. The gusset 24 may move from the retracted position in FIGS. 1-2 to the extended position in FIG. 3 as the apparel item 10 is being worn in a way that requires a greater range of motion at the location of the gusset 24, which is the arm hole region in the apparel item shown in FIG. 3. For instance, a greater range of motion at the arm hole region may be beneficial and, therefore, cause the gusset 24 to move to an extended position when a wear moves an arm across his or her body, as shown in FIG. 3.

As visible from the exterior of the apparel item 10, the gusset 24 connects the exterior shell layer 12 and the arm sleeve 14 in the shoulder region of the apparel item 10. Though not visible from the exterior view provided by FIG. 3, the gusset 24 also connects to the inner liner layer 22 at the shoulder region, which is described further in reference to FIGS. 5-7. In other aspects, the gusset 24 is located in different regions based on the type of sleeve connected to the gusset 24.

The apparel item 10, including the inner liner layer 22 and the exterior shell layer 12, and the gusset 24 may be constructed using a variety of textile materials. Various textiles may comprise, in one exemplary aspect, water-resistant and/or wind-resistant materials suitable for outdoor wear. Exemplary materials may comprise, for example, woven and/or knitted nylon or polyester fabrics, polyurethane laminates, vinyl, fabrics treated with water repellants such as laminated cotton, water-resistant/breathable fabrics (e.g. expanded polytetrafluroethylene), and the like. Although in some aspects only one type of material may be used, in an exemplary aspect, different types of materials are used for different pieces of the apparel item 10. For example, it may be desirable to have the exterior shell layer 12 constructed from a water-resistant material while using a knitted nylon for the inner liner layer 22. Other combinations of materials may be used for various pieces of the apparel item 10.

Figure 4:
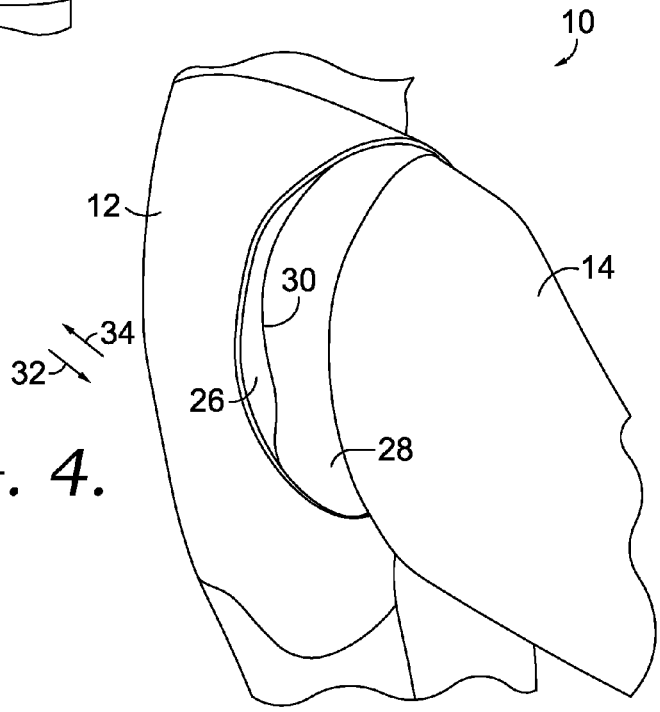
FIG. 4 is a close-up view of the extended sleeve gusset on the outerwear apparel of FIG. 3 in accordance with an aspect herein.

Turning to FIG. 4, a close-up view of the gusset 24 in extended form shows how the gusset 24 connects the exterior shell layer 12 and the arm sleeve 14. The gusset 24 comprises an exterior facing 26, otherwise known as a second exterior layer 26, and an interior facing 28 otherwise known as a first interior layer 28. The exterior facing 26 and the interior facing 28 may be formed from a single piece of fabric in a circular configuration or may be constructed from multiple pieces of fabric sewn together. Further, the interior facing 28 and/or the exterior facing 26 may each comprise a single layer or multiple layers of fabric. For example, it may be desirable to construct the interior facing 28 from two different materials as one surface of the interior facing 28 is at least partially exposed to the external environment when the gusset 24 is extended, as shown in FIG. 4, while another surface of the interior facing 28 is only visible when viewing the interior of the apparel item 10. In this instance, it may be desirable to construct one layer, such as an exterior-facing layer of the interior facing 28 from a water-resistant material or the same material as the exterior shell layer 12 while constructing a second layer, or an interior-facing layer, of the interior facing 28 from the same material as the inner liner layer 22.

As illustrated in FIG. 4, the exterior facing 26 is connected to the exterior shell layer 12, and the interior facing 28 is connected to the arm sleeve 14. The exterior facing 26 and the interior facing 28 are further connected to each other to form a bi-fold pleat 30. As the gusset 24 moves from the retracted position to the extended position, the bi-fold pleat 30 moves in the direction 32. As the gusset 24 returns back to its retracted position, the bi-fold pleat 30 moves in the direction 34, further inside the exterior shell layer 12.

Figure 5:
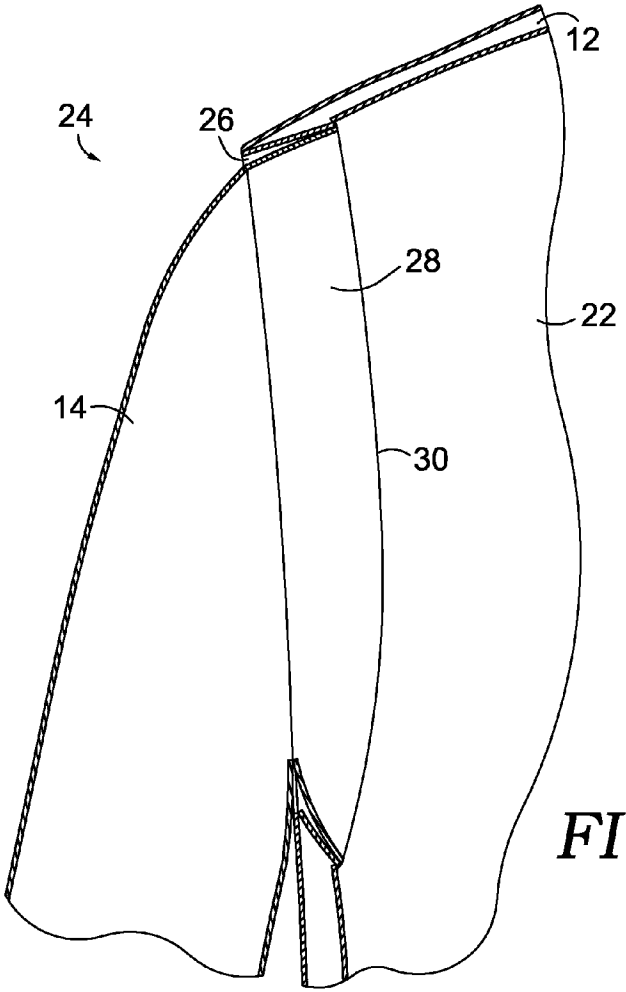
FIG. 5 is a front view of the interior of an apparel item with the sleeve gusset in accordance with an aspect herein.

FIG. 5 provides an interior view of the gusset 24 attached to the apparel item 10. Unlike with the exterior views in FIGS. 3-4, FIG. 5 illustrates how the inner liner layer 22 is coupled to the arm sleeve 14 and the exterior shell layer 12 via the gusset 24. In this aspect, the inner liner layer 22 is attached to the gusset 24 at the bi-fold pleat 30. The exterior shell layer 12 is coupled to the exterior facing 26 of the gusset 24 while the arm sleeve 14 is coupled to the interior facing 28 of the gusset 24.

Figure 6:
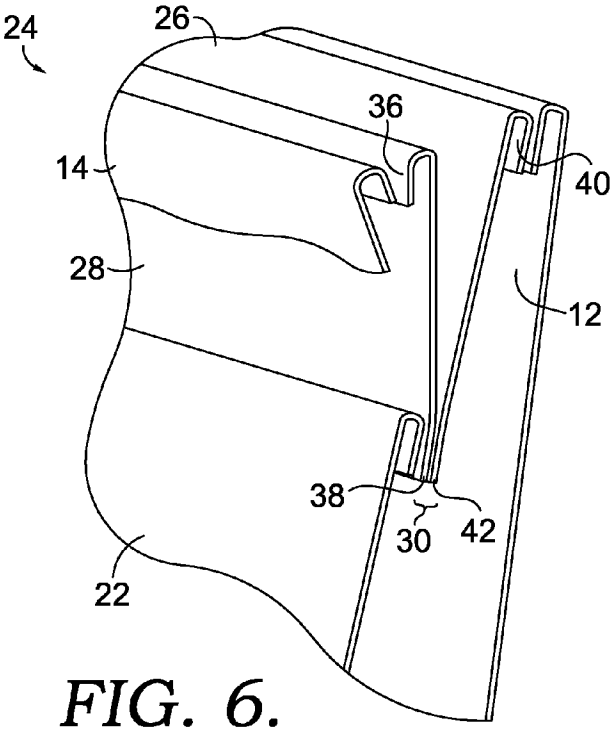
FIG. 6 is a perspective, close-up view of the interior of the apparel item with a sleeve gusset of FIG. 5 in accordance with an aspect herein.

Turning to the perspective, close-up view of the gusset 24 in FIG. 6, the specific points of attachment along the gusset 24 in one aspect are illustrated. The interior facing 28 of the gusset 24 comprises a sleeve edge 36, otherwise known as first edge 36, and a body edge 38, otherwise known as a second edge 38. The exterior facing 26 of the gusset 24 also comprises a sleeve edge 40, otherwise known as a third edge 40, and a body edge 42, otherwise known as a fourth edge 42. In an exemplary aspect, at least a portion of the body edge 38 of the interior facing 28 is coupled to at least a portion of the body edge 42 of the exterior facing 26. The coupling of the exterior facing 26 and the interior facing 28 forms the bi-fold pleat 30 of the gusset 24. Accordingly, the bi-fold pleat 30 may be constructed by coupling at least two pieces of material. In other aspects, as previously mentioned, the exterior facing 26 and the interior facing 28 may be constructed from a single piece of material. In this instance, a bi-fold pleat 30 may be created by folding a single piece of material onto itself where one side of the fold comprises the interior facing 28 and the other side comprises the exterior facing 26.

Continuing with respect to FIG. 6, the exterior facing 26 is coupled to the exterior shell layer 12 at the sleeve edge 40 of the exterior facing 26. The interior facing 28 is coupled to the inner liner layer 22 at the body edge 38 of the interior facing 28. The interior facing 28 is further coupled to the arm sleeve 14 at the sleeve edge 36 of the interior facing 28.

The coupling between the interior facing 28, the exterior facing 26, the exterior shell layer 12, the inner liner layer 22, and the arm sleeve 14 may be done by permanently affixing or securing these pieces together by, for example, stitching, adhesives, bonding, and the like. In other aspects, the pieces may be removably affixed to one another by, for instance, buttons, zippers, snap closures, hook-and-loop fasteners, and the like. Although the specific type of technology used to secure together the different pieces of the apparel item is not shown in FIG. 6, it is understood that FIG. 6 is meant to encompass any of the aforementioned types of affixing technologies.

Figure 7:
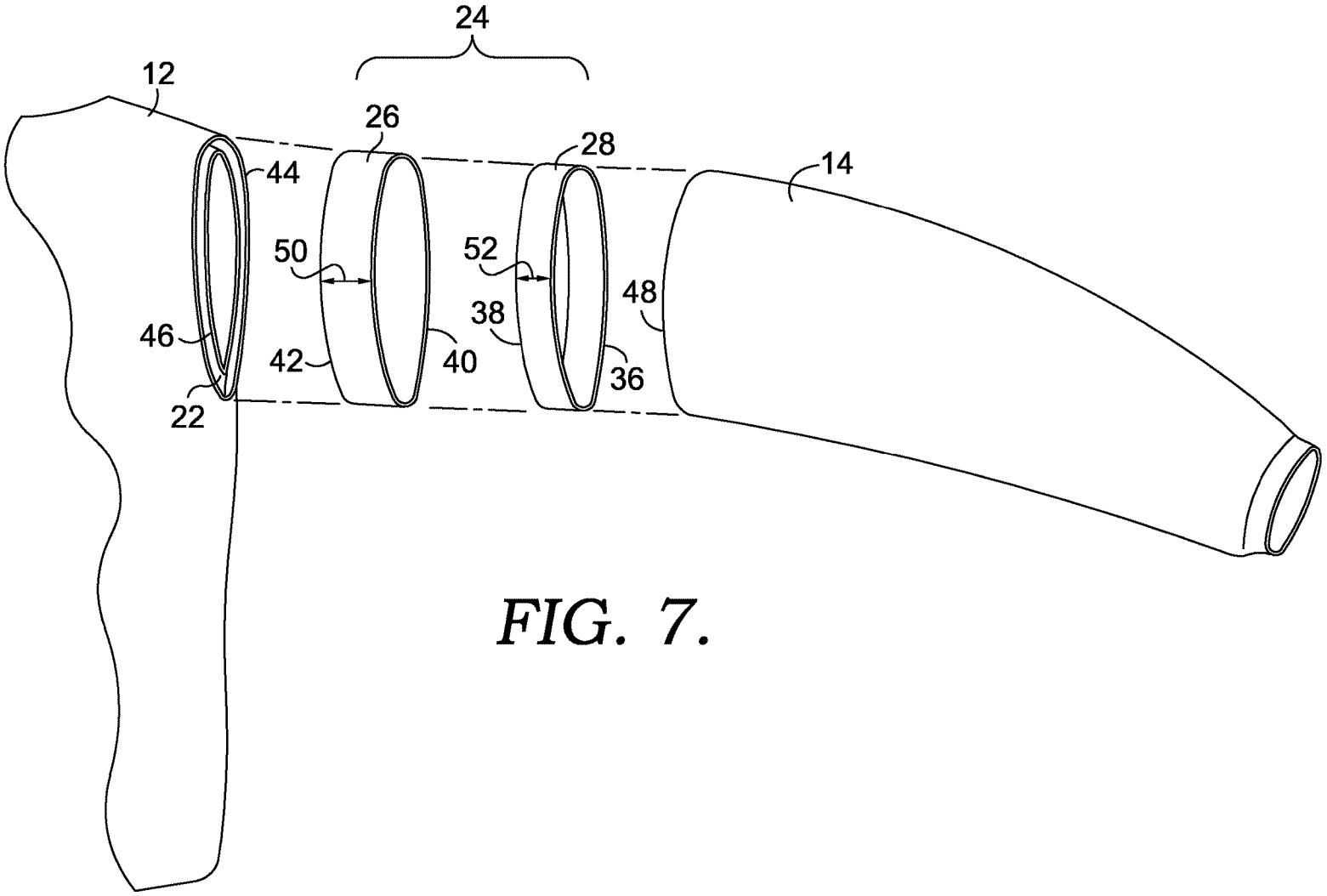
FIG. 7 is an exploded, side view of an exemplary apparel item with the sleeve gusset in accordance with an aspect herein.

Lastly, FIG. 7 provides an exploded view of an apparel item using the gusset 24 to connect an exterior shell layer 12, an inner liner layer 22, and an arm sleeve 14. In an exemplary aspect, the exterior shell layer 12 has a sleeve opening edge 44, otherwise known as an outer edge 44 of the garment body, and the inner liner layer 22 has a sleeve opening edge 46, otherwise known as an outer edge 46 of the garment lining. The inner liner layer 22 may be positioned underneath the exterior shell layer 12 and oriented so that the sleeve opening edge 46 of the inner liner layer 22 aligns with the sleeve opening edge 44 of the exterior shell layer 12.

Continuing, the exterior facing 26 of the gusset 24 has a sleeve edge 40 and a body edge 42, and the interior facing 28 of the gusset 24 also has a sleeve edge 36 and a body edge 38. The sleeve edge 40 of the exterior facing 26 may be fixed to the exterior shell layer 12 at the sleeve opening edge 44 of the exterior shell layer 12. Accordingly, the circumference of the exterior facing 26 at its sleeve edge 40 may correspond to the circumference of the sleeve opening edge 44 of the exterior shell layer 12. The exterior facing 26 may be fixed to the interior facing 28 along the body edge 42 of the exterior facing 26 and the body edge 38 of the interior facing 28. Additionally, the body edge 38 of the interior facing 28 may also be fixed to the inner liner layer 22 at the sleeve opening edge 46 of the inner liner layer 22. Accordingly, the circumference of the interior facing 28 at its body edge 38 may correspond to the circumference of the exterior facing 26 at its body edge 42 and the circumference of the sleeve opening edge 46 of the inner liner layer 22. Lastly, the sleeve edge 36 of the interior facing 28 may be fixed to the arm sleeve 14 at the sleeve opening 48, otherwise known as an outer edge 48 of the arm sleeve 14. Accordingly, the circumference of the interior facing 28 at its sleeve edge 36 may correspond to the circumference of the sleeve opening 48 of the arm sleeve 14.

While FIG. 7 provides an exploded view of these pieces, when the pieces are attached and the gusset 24 is in a retracted form, the interior facing 28 may be positioned within the center of the exterior facing 26. The sleeve edge 40 of the exterior facing 26 may be configured to align with the sleeve opening edge 44 of the exterior shell layer 12, with the exterior facing 26 extending underneath the exterior shell layer 12. Consequently, as noted from FIGS. 1-2, the exterior facing 26 and the interior facing 28 may not be visible when viewing the exterior of the apparel item 10 when the gusset 24 is in a retracted position.

Figure 8:
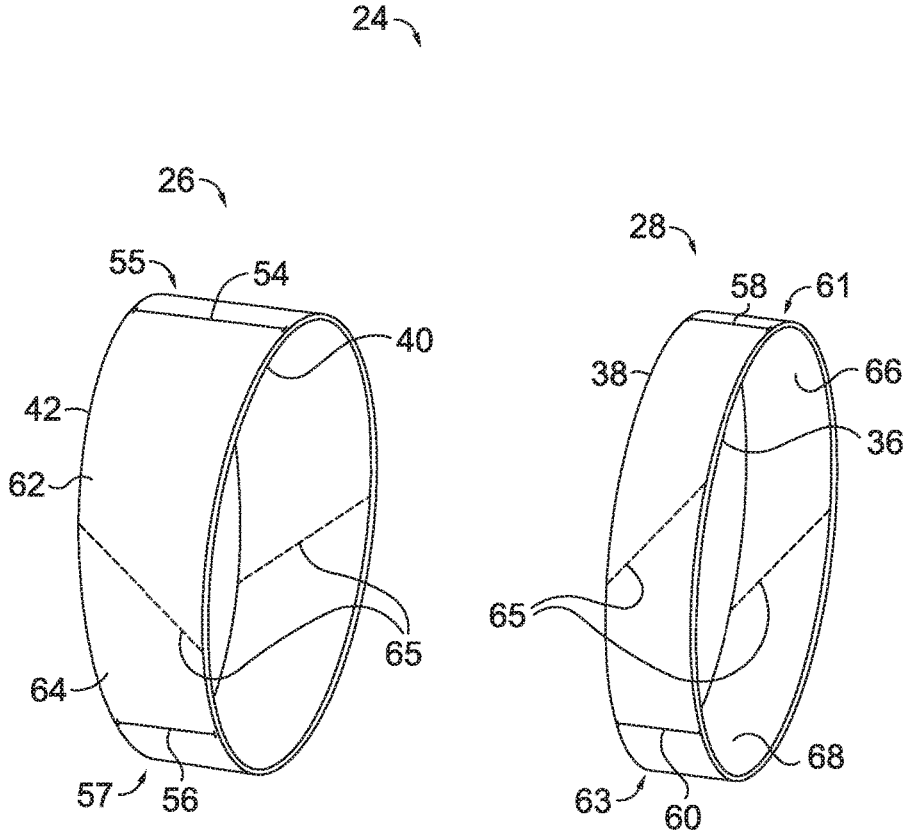
FIG. 8 is an exploded, side view of an exemplary sleeve gusset in accordance with an aspect herein.

As shown in FIG. 7, in exemplary aspects, the exterior facing 26 is a first curved circular shape, and the interior facing 28 is a second curved circular shaped. In some aspects, each curved circular shape comprising the exterior facing 26 and the interior facing 28 is formed from a single piece of material. In other aspects, as illustrated in FIG. 8, the exterior facing 26 and/or the interior facing 28 may be include multiple pieces of fabric spliced together along, for example, dashed lines 65. For example, as illustrated in FIG. 8, the exterior facing 26 may comprise a first semi-circular piece 62 and a second semi-circular piece 64, and the interior facing 28 may also comprise a first semi-circular piece 66 and a second semi-circular piece 68. Each semi-circular piece 62, 64, 66, and 68 may have two curved edges and two straight edges. The first and second semi-circular pieces 62 and 64, respectively, may be attached along their straight edges (at dashed lines 65) to form a single circular shape for use as the exterior facing 26 while the first and second semi-circular pieces 66 and 68 may be attached along their straight edges (at dashed lines 65) to form a single circular shape for use as the interior facing 28.

In some aspects, the width 52 of the interior facing 28, or the distance between the sleeve edge 36 and the body edge 38, is smaller than the width 50 of the exterior facing 26, or the distance between the sleeve edge 40 and the body edge 42 of the exterior facing 26. For example, in some aspects, the width 50 of the exterior facing 26 may be 15 millimeters to 5 millimeters greater than the width 52 of the interior facing 28. The larger width of the exterior facing 26 when compared to the interior facing 28 may be uniform around the whole curved shaped of the exterior facing, such as in the aspect depicted in FIG. 7.

In some aspects, including the one depicted in FIG. 8, the exterior facing 26 may have a width that varies such that a second width 54 of an upper portion 55 of the exterior facing 26 differs from a third width 56 of a bottom portion 57. In other words, the exterior facing 26 may be wider than the interior facing 28 only at one portion on the exterior facing 26. For instance, the second width 54 of an upper portion 55 of the exterior facing 26 may be greater than a first width 58 of an upper portion 61 of the interior facing 28, while the third width 56 of the lower portion 57 of the exterior facing 26 may be substantially the same as a fourth width 60 of the lower portion 63 of the interior facing 28. In aspects not shown, the interior facing 28 and the exterior facing 26 may both have a varying width.

Lastly, in some aspects, the bi-fold pleat 30 may be secured to only one portion on the exterior shell layer 12 of the apparel item 10. For example, the bi-fold 30 pleat may be attached to the exterior shell layer 12 at one portion along the top of the shoulder region in apparel item 10. Such a configuration provides a single point of direct attachment between the exterior shell layer 12 and the inner liner layer 22, which is coupled to the bi-fold pleat 30, while allowing the gusset 24 to provide the only means of attachment between the inner liner layer 22 and the exterior shell layer 12 around the rest of the arm hole. In other aspects, the bi-fold pleat 30 is secured to the exterior shell layer 12 at multiple points. Alternatively, the bi-fold pleat 30 may not be directly secured to the exterior shell layer 12 at all. Any and all aspects, and any variation thereof, are contemplated as being within the scope herein.

Figure 9:
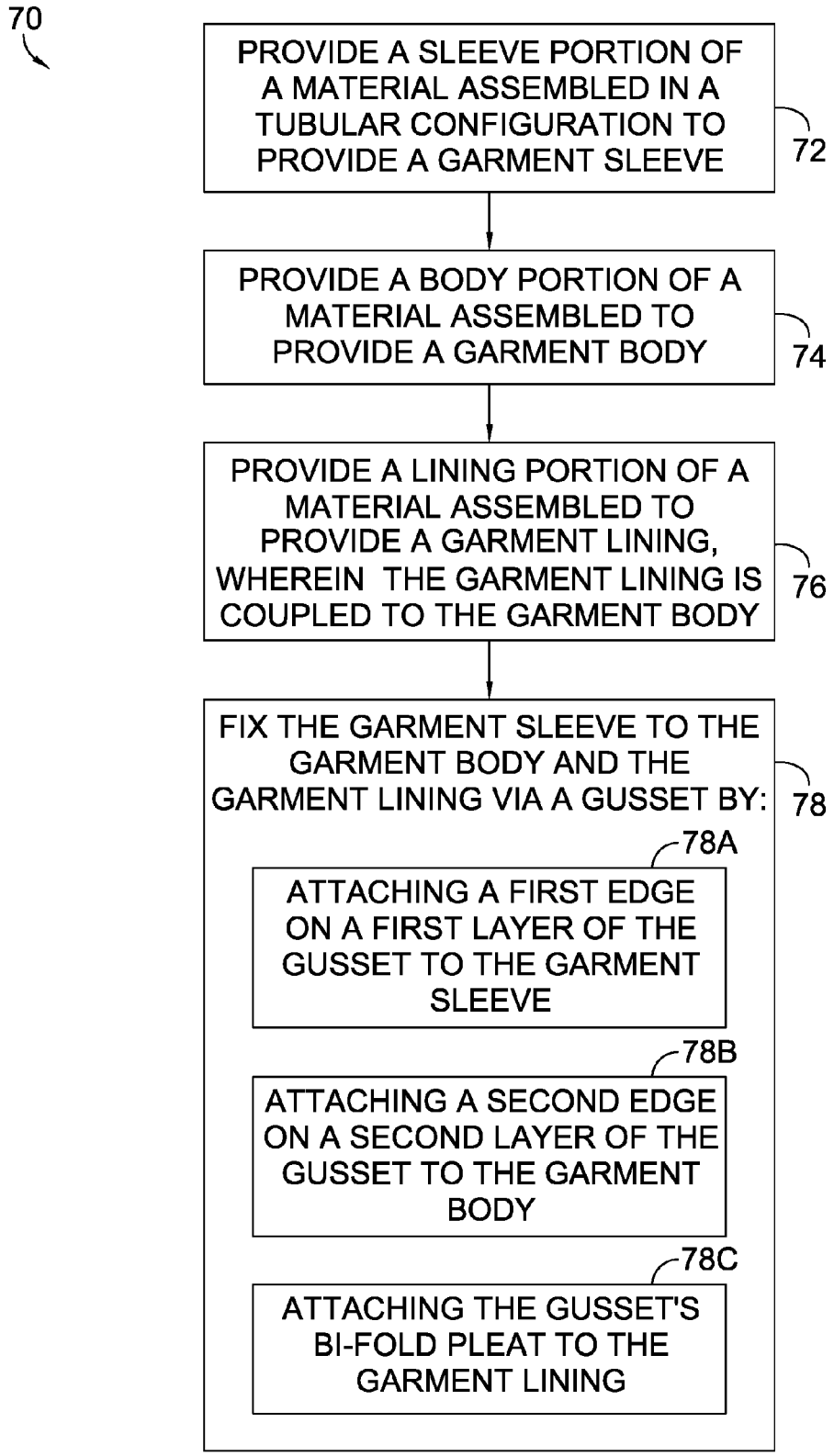
FIG. 9 is a flow diagram of an exemplary method of manufacturing a gusseted garment in accordance with an aspect herein.

With respect to FIG. 9, FIG. 9 depicts a flow diagram of an exemplary method 70 of manufacturing a gusseted garment (such as the apparel item 10 with the gusset 24 shown in FIGS. 1-8). At step 72 of the method 70, a sleeve portion of material is provided. The sleeve material may be assembled in a tubular configuration to provide a garment sleeve (such as the arm sleeve 14 in FIG. 3). Next, at step 74, a body portion of a material is provided, the body portion being assembled to provide a garment body, otherwise known as the exterior shell layer 12 shown in FIG. 3. A lining portion of material is then provided at step 76. The lining portion of material may be assembled to provide a garment lining, otherwise known as inner lining layer 22 as seen in FIG. 5, and may be coupled to the garment body 12. In exemplary aspects, the garment body 11 comprises a first width that is larger than a second width of the garment lining.

Lastly, at step 78, the garment sleeve is fixed to the garment body 12 and the garment lining via a gusset (such as the gusset 24 in FIG. 6). Step 78, or fixing the garment sleeve to the garment body 12 and the garment lining 22 via a gusset 24, comprises three sub-steps. At step 78A, a first edge 36 on a first interior layer 28 of the gusset (i.e., an interior facing) is attached to the garment sleeve 14, and at step 78B, a second edge 40 of on a second exterior layer 26 of the gusset (i.e., an exterior facing) is attached to the garment body 12. Lastly, a bi-fold pleat 30 of the gusset, which is formed by the second edge 38 of the first interior layer 28 and the second edge 42 of the second exterior layer 26, is attached to the garment lining 22 at step 78C, wherein the bi-fold pleat 30 is between the first interior layer 28 and the second exterior layer 26 of the gusset 24. In some aspects, the method 70 also comprises securing the bi-fold pleat 30 at a single portion of the garment body 12.

In some aspects of the method 70, the first edge 36 on the first interior layer 28 of the gusset 24 is configured to couple to an outer edge 48 of the garment sleeve 14, wherein the outer edge 48 corresponds to a sleeve opening of the sleeve 14. The second edge 40 on the second exterior layer 26 of the gusset 24 may be configured to couple to outer edge 44 of the-garment body 12 that corresponds to the sleeve opening on the garment body 12. Lastly, the bi-fold pleat 30 between the first interior layer 28 and the second exterior layer 26 of the gusset 24 may be configured to couple to an outer edge 46 of the garment lining 22, wherein the outer edge 46 corresponds to a sleeve opening of the garment lining 22.

Many different arrangements of the various components depicted, as well as components not shown, are possible without departing from the scope of the claims below. Aspects of the technology have been described with the intent to be illustrative rather than restrictive. Alternative aspects will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A bi-fold gusset system comprising:

a first interior layer that has a first edge and a second edge opposite the first edge, the first interior layer having a first width at an upper portion of the first interior layer as measured between the first edge and the second edge; and a second exterior layer that has a third edge and a fourth edge opposite the third edge, the second exterior layer having a second width at an upper portion of the second exterior layer as measured between the third edge and the fourth edge, the second exterior layer having a third width at a lower portion of the second exterior layer as measured between the third edge and the fourth edge, wherein the second width of the second exterior layer is greater than the first width of the first interior layer, and wherein the second width of the second exterior layer is greater than the third width of the second exterior layer, and further wherein at least a portion of the second edge of the first interior layer is coupled to at least a portion of the fourth edge of the second exterior layer to form a bi-fold pleat;

wherein at least a portion of the fourth edge of the second exterior layer is configured to be coupled to a sleeve opening of an exterior shell layer of an apparel item, at least a portion of the first edge of the first interior layer is configured to be coupled to a sleeve opening of an inner liner layer of the apparel item, and at least a portion of the second edge of the first interior layer is configured to be coupled to a sleeve.

2. The bi-fold gusset system of claim 1, wherein the bi-fold pleat is adapted to be secured at a single portion of the exterior shell layer.

3. The bi-fold gusset system of claim 1, wherein the first interior layer comprises an exterior facing surface and an interior facing surface.

4. The bi-fold gusset system of claim 1, wherein the first interior layer comprises a first curved circular shape.

5. The bi-fold gusset system of claim 4, wherein the second exterior layer comprises a second curved circular shape.

6. The bi-fold gusset system of claim 1, wherein the first interior layer and the second exterior layer comprise a single piece of material.

7. The bi-fold gusset system of claim 1, wherein the first interior layer comprises a first piece of material, and wherein the second exterior comprises a second piece of material different from the first piece of material.

8. The bi-fold gusset system of claim 1, wherein the second width at the upper portion of the second exterior layer is 5 millimeters to 15 millimeters greater than the first width at the upper portion of the first interior layer.

9. An enhanced mobility garment comprising:

an exterior shell layer having at least one sleeve opening and adapted to cover at least a portion of a wearer's torso when in an as-worn configuration;

an inner liner layer positioned adjacent and interior to the exterior shell layer, the inner liner layer having at least one sleeve opening circumferentially aligned with the sleeve opening of the exterior shell layer, the inner liner layer adapted to cover at least a portion of a wearer's torso when in an as-worn configuration;

at least one sleeve; and at least one gusset comprising:

a first interior layer having a first edge and a second edge opposite the first edge, the first interior layer having a first width at an upper portion of the first interior layer as measured between the first edge and the second edge; and a second exterior layer having a third edge and a fourth edge opposite the third edge, the second exterior layer having a second width at an upper portion of the second exterior layer as measured between the third edge and the fourth edge, the second exterior layer having a third width at a lower portion of the second exterior layer as measured between the third edge and the fourth edge, wherein the second width of the second exterior layer is greater than the first width of the first interior layer and wherein the second width of the second exterior layer is greater than the third width of the second exterior layer, wherein at least a portion of the third edge of the second exterior layer is coupled to the exterior shell layer at the at least one sleeve opening of the exterior shell layer, at least a portion of the fourth edge of the second exterior layer is coupled to at least a portion of the second edge of the first interior layer to form a bi-fold pleat, at least a portion of the second edge of the first interior layer is further coupled to the inner liner layer at the sleeve opening of the inner liner layer, and at least a portion of the first edge of the first interior layer is coupled to the sleeve such that the sleeve is coupled to both the exterior shell layer and the inner liner layer via the gusset.

10. The enhanced mobility garment of claim 9, wherein the gusset is constructed from one or more of a water-resistant material, a woven nylon, a knitted nylon, a woven polyester, and a knitted polyester.

11. The enhanced mobility garment claim 9, wherein the bi-fold pleat is secured at a single portion of the exterior shell layer.

12. The enhanced mobility garment of claim 9, wherein the first interior layer comprises an exterior facing surface and an interior facing surface.

13. The enhanced mobility garment of claim 9, wherein the exterior shell layer comprises a first width and the inner liner layer comprises a second width, wherein the second width of the inner liner layer is smaller than the first width of the exterior shell layer.

14. The enhanced mobility garment of claim 13, wherein the gusset is configured to move from a retracted position to an extended position based on a difference between the first width of the exterior shell layer and the second width of the inner liner layer and a coupling of the exterior shell layer, the inner liner layer, and the at least one sleeve via the gusset with the bi-fold pleat.

15. The enhanced mobility garment of claim 9, wherein the first interior layer comprises a first curved circular shape, wherein:

the first edge of the first interior layer corresponds to a circumference of the sleeve opening of the at least one sleeve; and the second edge of the first interior layer corresponds to a circumference of the at least one sleeve hole of the inner liner layer.

16. The enhanced mobility garment of claim 15, wherein the second exterior layer comprises a second curved circular shape, wherein:

the fourth edge of the second exterior layer corresponds to a circumference of the second edge of the interior facing; and the third edge of the second exterior layer corresponds to a circumference of the at least one sleeve hole of the exterior shell layer.

17. A method of manufacturing a bi-fold gusset for use in an apparel item, the method comprising:

providing a sleeve portion of a material assembled in a tubular configuration to provide a garment sleeve, the garment sleeve having a proximal sleeve opening and a distal sleeve opening;

providing a body portion of a material assembled to provide a garment body, the body portion comprising an exterior shell layer having at least one sleeve opening;

providing a lining portion of a material assembled to provide an inner liner layer, wherein the inner liner layer is positioned adjacent and interior to the exterior shell layer and coupled to the exterior shell layer, further wherein the inner liner layer has at least one sleeve opening circumferentially aligned with the sleeve opening of the exterior shell layer;

fixing the garment sleeve to the exterior shell layer and the inner liner layer via a gusset comprising:

a first interior layer having a first edge and a second edge opposite the first edge, the first interior layer having a first width at an upper portion of the first interior layer as measured between the first edge and the second edge; and a second exterior layer having a third edge and a fourth edge opposite a third edge, the second exterior layer having a second width at an upper portion of the second exterior layer as measured between the third edge and the fourth edge, the second exterior layer having a third width at a lower portion of the second exterior layer as measured between the third edge and the fourth edge, wherein the second width of the second exterior layer is greater than the first width of the first interior layer and wherein the second width of the second exterior layer is greater than the third width of the second exterior layer, wherein affixing the garment sleeve to the exterior shell layer and the inner liner layer via the gusset comprises:

attaching the first edge of a first interior layer of the gusset to the garment sleeve, attaching the third edge of the second exterior layer of the gusset to the exterior shell layer to form a bi-fold pleat, attaching the bi-fold pleat of the gusset to the inner liner layer, wherein the bi-fold pleat is formed by attaching a second edge of the first interior layer to a fourth edge of the second exterior layer.

18. The method of claim 17, wherein the exterior shell layer comprises a first width and the inner liner layer comprises a second width, wherein the second width of the inner liner layer is smaller than the first width of the exterior shell layer.

19. The method of claim 17, further comprising securing the bi-fold pleat at a single portion of the exterior shell layer.

20. The method of claim 17, wherein:

the first edge of the first interior layer of the gusset is coupled to the proximal sleeve opening of the garment sleeve, the third edge of the second exterior layer of the gusset is coupled to the sleeve opening of the exterior shell layer, and the bi-fold pleat between the first interior layer and the second exterior layer of the gusset is coupled to the sleeve opening of the inner liner layer.

* * * * *